US006250622B1

(12) United States Patent
Fowler et al.

(10) Patent No.: US 6,250,622 B1
(45) Date of Patent: Jun. 26, 2001

(54) CYLINDER ASSEMBLY FOR A FOLDING APPARATUS OF A ROTARY PRINTING PRESS

(75) Inventors: Gary Frank Fowler, Keene; Wayne Harvey Garland, Dover; Michael Alexander Novick, New Durham, all of NH (US)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/315,331

(22) Filed: May 20, 1999

(51) Int. Cl.[7] ..... B42C 1/00

(52) U.S. Cl. ..... 270/47; 270/20.1; 270/19; 270/41; 270/42; 493/424; 493/434; 492/38; 492/49

(58) Field of Search ..... 271/314, 277; 493/424–435, 445; 492/38, 49; 270/47–51, 20.1, 19, 41, 42

(56) References Cited

U.S. PATENT DOCUMENTS 1,821,713 * 9/1931 Johansen ..... 493/431
2,229,487 * 1/1941 Barber ..... 493/429
2,335,431 * 11/1943 Meyer ..... 493/429
3,180,007 * 4/1965 Gartz ..... 492/38
4,349,185 * 9/1982 Small et al. ..... 270/32
5,000,433 3/1991 Prüm et al. .
5,029,829 * 7/1991 Hein et al. ..... 493/424
5,039,076 8/1991 Fischer .
5,466,212 * 11/1995 Springer ..... 493/434

* cited by examiner

*Primary Examiner*—H. Grant Skaggs
(74) *Attorney, Agent, or Firm*—Herbert L. Lerner; Laurence A. Greenberg; Werner H. Stemer

(57) ABSTRACT

The present invention is related to a paper conducting cylinder in a folder which is assigned to a rotary printing press such as a rotary newspaper printing press. A plurality of cylinder's surface sections (19) is mounted about the circumference of said cylinder (8). Each of said surface sections (19) being of layered structure comprises a compressible material (24) adhesively attached thereto. Said surface sections (19) are removably secured to mounting surfaces (29) of said cylinder (8), preferably on its side walls.

19 Claims, 2 Drawing Sheets

Figure 1:
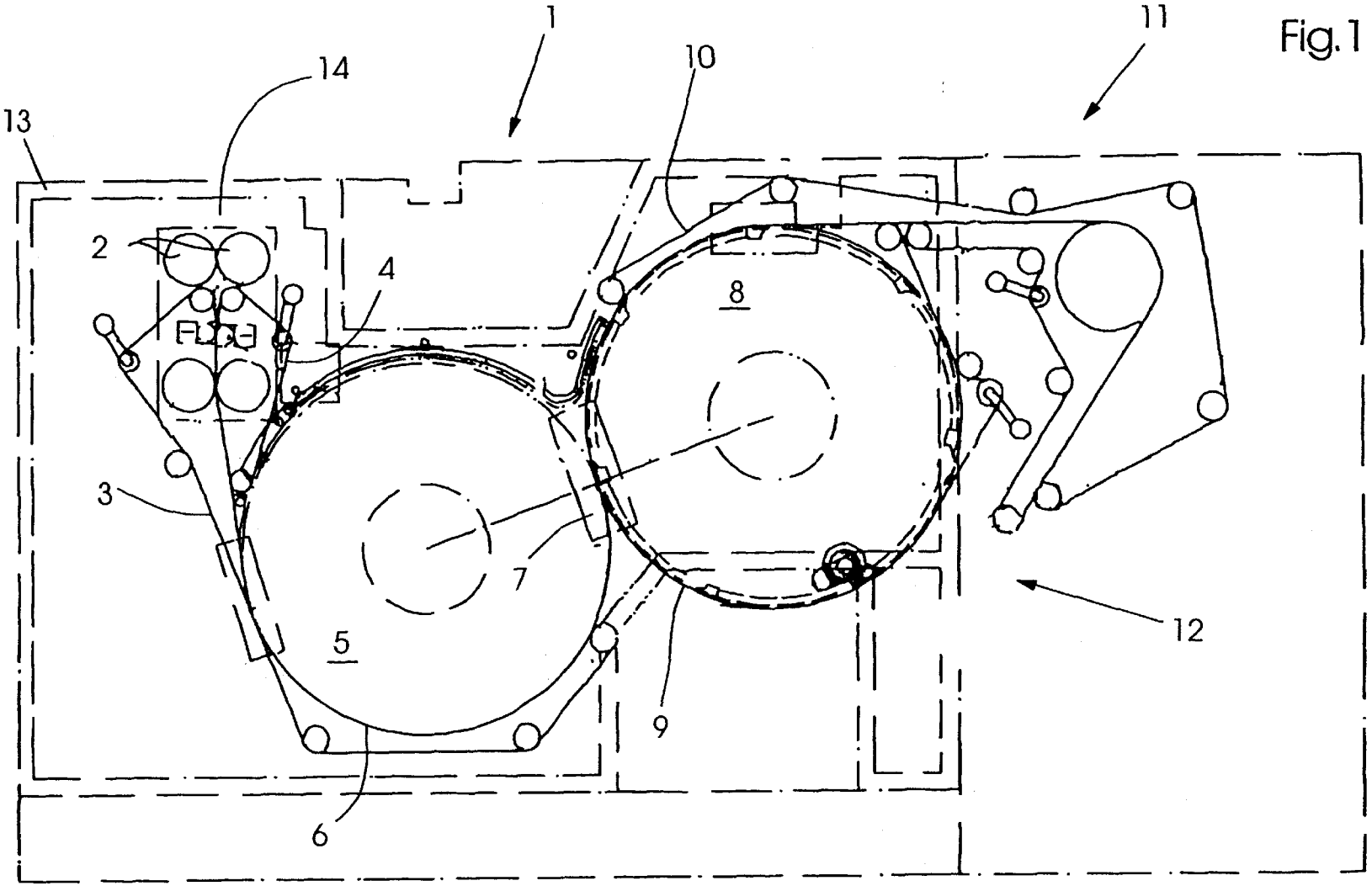

11
12
10
8
9
1
7
4
14
5
6
2
3
13

CYLINDER ASSEMBLY FOR A FOLDING APPARATUS OF A ROTARY PRINTING PRESS

FIELD OF THE INVENTION

The present invention is related to a compressible cylinder cap assembly for a cylinder in a folder apparatus arranged behind a rotary printing press.

BACKGROUND OF THE INVENTION

Under U.S. Ser. No. 09/124,907 on Jul. 30, 1998 a patent application has been filed entitled "Device for varying a cylinder's effective diameter". This disclosure is related to a device for the variation of a cylinder's effective diameter. It includes a shell member being removably mounted on a surface of a cylinder. On said easy exchangeable shell members having a base plate, an elastic material is provided allowing for a compressible surface gain. The solution enclosed in U.S. Ser. No. 09/124,907 allows for facilitation of the cylinder's effective diameter, so as to provide a quick change of a cylinder's gain according to the requirements.

Due to the very thin surface coating the compensation achievable with the solution is very much limited.

U.S. Pat. No. 5,039,076 is related to a folder. In the case of a folder with at least two folding cylinders having cooperating folding members in the form of folding blades and folding jaws and intended for processing products of very different thickness, more reliable operation may be achieved if at least one folding cylinder has circumferential sections which are able to be adjusted in the radial direction. Setting means are provided for adjusting said circumferential sections in a radial direction, wherein said circumferential sections are arranged and tillable about an axis parallel to the cylinder's axis provided in an area of a leading end of said circumferential sections and with a trailing end of said circumferential sections being extendable in a radial direction by means of said setting means.

U.S. Pat. No. 5,000,433 is likewise related to a folder and more particularly to an adjustable folder for web-fed gravure presess comprising a collect cylinder. Said collect cylinder is able to be set for collect runs and non-collect runs and provided with holding elements (preferably in the form of grippers) and tucking blades having actuating elements preferably in the form of follower rollers which are operated by a respective cam, whose active cam part, which is preferably in the form of a recess, is adapted to be selectively exposed and covered over by means of a covering means which is coaxial to the cam and is provided with drive cam elements which are mounted on a cam element carriers coaxial to the cam and are able to be driven. In order to achieve a high degree of adaptablility as regards different types of collect operations the covering cam elements of the covering device are mounted on the cam element carrier in such a manner that they may be radially adjusted.

SUMMARY OF THE INVENTION

In the technical field, particularly in those applications where newspaper of higher page numbers, such as 48 or 64 pages are produced, much maintenance time is needed to get the folder in production after a system jam has occurred. To allow for a high degree of flexibility and deflection of a paper conducting cylinder's surface, such as a jaw cylinder or a folding blade cylinder, and to provide for a deflecting movement single strips have been mounted spaced apart from each other on the surface of a respective paper conducting cylinder. These strips manufactured of a closed cell urethane form attached to a plastic only provide for a limited deflection on the surface of a paper conducting cylinder such as a jaw cylinder. Upon production of newspaper of 48 pages and even more pages a higher degree of deflection on the respective paper conducting cylinder surface is required.

Accordingly, it is an object of the present invention to increase a paper conducting cylinder's ability to withstand major paper jams occuring between cooperating cylinders.

Further, it is an object of the present invention to reduce significantly broken or damaged cylinder parts.

Still further it is an object of the invention to provide for a cylinder surface design allowing for less maintenance time for repair during major paper jams.

According to the present invention a paper conducting cylinder in a folder comprises:

- a plurality of cylinder surface sections mounted about the circumference of a cylinder,
- said surface sections of layered structure having a compressible material adhesively attached thereto,
- said surface sections being removably secured to mounting sections of said cylinder.

The advantages of the solution according to the present invention reside in the extremely short periods required to exchange the surface sections in case of a jam. Due to the compressibility of said cylinder's surface portions part of the cylinder surfaces deflect to the respective centre of said paper conducting cylinder and to create more space in the nip with regard to a cooperating cylinder. Thus, no parts of said complex paper conducting cylinders are damaged allowing for a fast start-up of the production again. Said surface portions being resiliently mounted on said cylinder body are apt for a deflection to a higher extent, thus allowing to transport even products such as newspaper having a higher number of papers without any adjustment to the nip.

According to further advantageous embodiments of the present invention said surface sections are layered structures and comprise a hard plastic stabilizing layer. By means of said hard stabilizing layer the rigidity of said layered structure of the entire surface section is enhanced. Further, said layered structure may comprise a cover having belt grooves. Besides of that below said layered structure of the surface sections a cap base is mounted between said surface sections and said mounting surfaces on the side frames of the respective paper conducting cylinder such as a collecting cylinder, a folding blade cylinder or a jaw cylinder.

Said hard plastic stabilizing layer which may be comprised of the layered structure acts as a belt drive, since said belt grooves provided in the cover on top of the layered structure has,spaced apart from each other, belt grooves, the bottom of which is constituted by said hard plastic stabilizing layer. Said cover having the belt grooves may be made of hard urethane or of a rubber material. The preferred thickness of said cover on top of said layered structure is a thickness between 3 and 8 mm, preferably 6 mm.

Said compressible material attached on the lower arc-shaped surface of said hard plastic stabilizing layer may be a foamed material adhesively bonded to said hard plastic. It's thickness is preferably in the range between 15 and 25 mm, preferably at 22 mm. Below said compressible material being a foamed compressible material a cap base is arranged being made of hard plastic or being made of metal. Said cap base comprises a flat surface with which said cap base is mounted to the respective mounting surfaces on the side frames of said paper conducting cylinder and an arc-shaped upper surface which corresponds to the arc-shaped curvature of said compressible material attached to the hard plastic stabilizing layer of said layered structure. Said entire surface sections being a layered structure are mounted by removable fastening means such as screws or bolts to said mounting surfaces on the side frames of said cylinder between said mounting surfaces of said cylinder and said surface sections a cap base as described above being arranged.

In said folding apparatus said paper conducting cylinder are for example folding blade cylinders having arranged a plurality of folding blades on the circumference. Said paper conducting cylinder may also be jaw cylinders, one of which is described in further detail below and said paper conducting cylinder may be collecting cylinders.

An advantageous application of the solution according to the present invention are folder apparatuses which are designed to a rotary printing press such as a web-fed printing press apt for newspaper applications. The device according to the present invention may be arranged in a pinless folder apparatus. Said folders preferably being arranged behind a web-fed rotary printing press.

Figure 2:
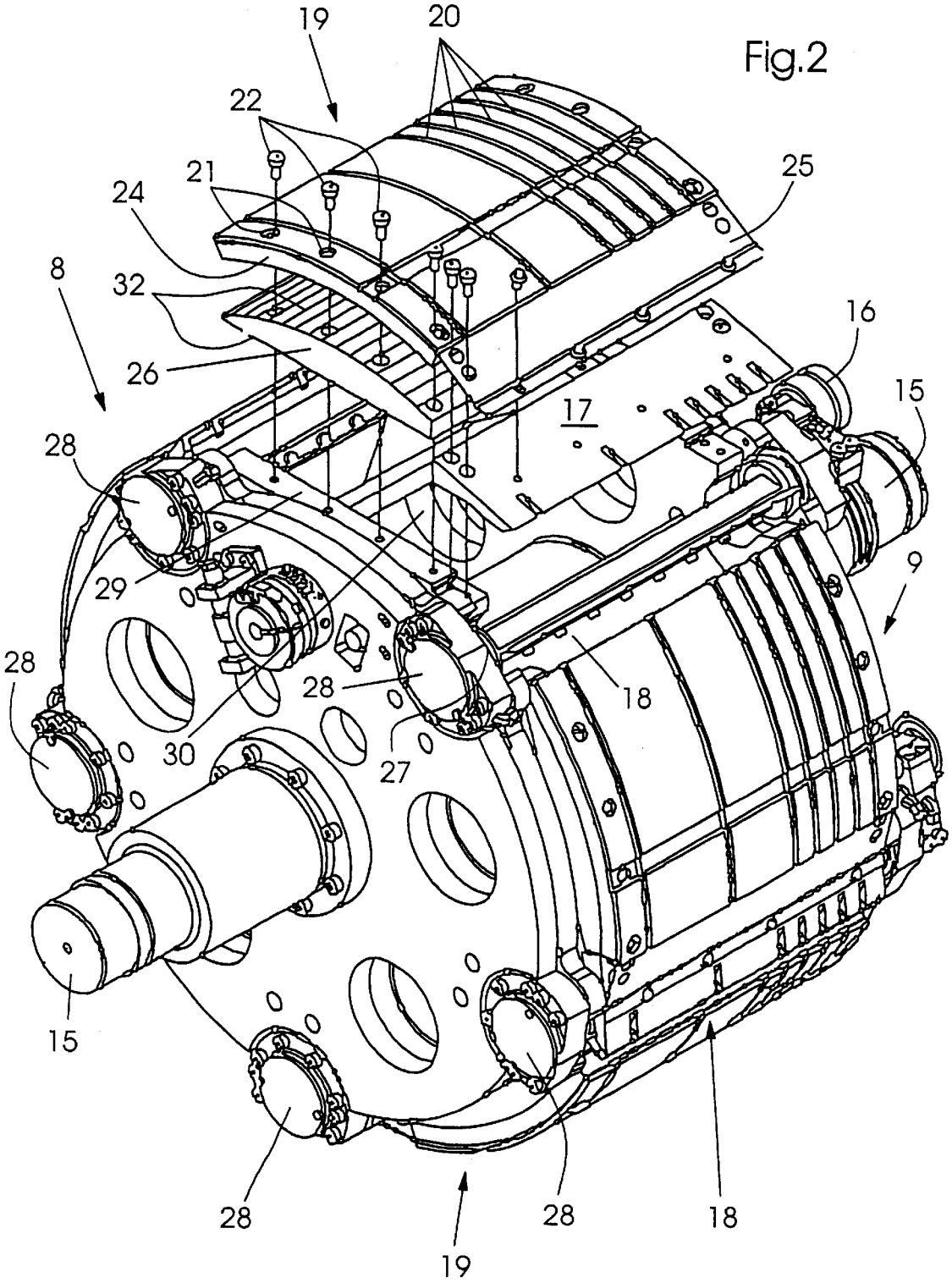

The novel features which are considered as characteristics for the invention are set forth in particular in the appended claims. The invention itself however, both as to its construction and its method of operation together with additional objects and advantages thereof will be best understood from the following description of a specific embodiment when read in connection with the accompanying drawings in which:

FIG. 1 is a side elevation of a folder apparatus having two paper conducting cylinders cooperating with each other, and FIG. 2 is a perspective view of a paper conducting cylinder of a folder apparatus such as a jaw cylinder having a plurality of jaws arranged on its respective circumference.

DESCRIPTION OF THE PREFERRED EMBODIMENTS

FIG. 1 is side elevation of a folder apparatus according to the present invention equipped with two cooperating paper conducting cylinders such as a folding blade cylinder and a jaw cylinder.

FIG. 1 shows a side elevation of a folder apparatus having two paper conducting cylinders cooperation with one another.

A folder apparatus, comprising two respective side frame assemblies 13 includes a web entry section 14 through which a respective web enter said folder apparatus 1. A pair of cooperating cutting cylinders 2 severe respective signatures from an incoming web of material, said signatures being severed from said web of material are received by a respective first and second sets of tapes 3, 4, respectively. Said signatures are seized by a first folding cylinder 5 such as a folding blade cylinder having a respective surface 6.

Within a schematically given product transfer area 7 said signatures severed from said web of material are transferred to a respective second paper conducting cylinder 8 such as a jaw cylinder 8 for example. Upon transfer from said first to said second folding cylinder 5, 8, respectively, the signatures are crossfolded and tucked by respective tucking blades into jaws arranged on the circumference of said second paper conducting cylinder 8. On the circumference of said second paper conducting cylinder 8 respective jaws are arranged spaced apart from each other about the cylinder's 8 surface 9. Said jaws 18 are shown in greater detail in FIG. 2.

Crossfolded products such as newspapers are delivered from the respective surface 9 of said second paper conducting cylinder 8 to respective sets of tapes 10 provided for product delivery to respective further processing equipment or stacking facilities or the like.

Instead of said substantially vertically extending product delivery path said products may be delivered along a substantially horizontal delivery path not shown in greater detail in the embodiment of the present invention according to FIG. 1.

The folder apparatus given schematically only in FIG. 1 may be a pinless folder apparatus seizing the products preferably by tape and belt arrangements provided along the product conveying path. In the alternative, it is also conceivable to have the present invention arranged in folders having pins for seizing said products on respective paper conducting cylinders 5, 8, respectively.

FIG. 2 shows a perspective view of a paper conducting cylinder such as a jaw cylinder according to the present invention.

A paper conducting cylinder 8 such as a jaw cylinder is provided along its outer circumference with a plurality of folding jaws. Said folding jaws each comprise a stationary jaw member 17 and a movable jaw member 18. Said jaws arranged on the folding cylinder's circumference receive upon a respective tucking blade movement signatures which have been crossfolded via the action of the folding blade which in turn is arranged on the circumference of a first paper conducting cylinder 5. Said tucking blades of said first paper conducting cylinder 5 cooperate with said folding jaws of said jaw cylinder 8 upon a crossfolding operation.

On the circumference of said jaw cylinder 8 cylinder surface sections 19 are arranged extending about the cylinder's circumference. Said cylinder surface sections 19 are of a layered structure.

On top of said cylinder surface section 19 a cover 20 having belt grooves is mounted. Said cover 20 is made of a highly wear-resistant material, which is quite durable, rather dense, but still flexible. Said belt grooves being spaced from one another about the width of said cover 20 serve as lateral guides for sets of belts or tapes or the like cooperating with said cylinder surface sections 19 allowing for product or signature transfer.

Below said cover 20 having belt grooves a hard plastic layer 25 is arranged. The material of this hard plastic layer 25 below said cover 20 serves as a belt drive and wear surface when contacted by the respective belts. Said hard plastic layer 25 has a curvature matching the outer conture of said paper conducting cylinder 8. On the rearward side of said hard plastic layer 25 the compressible material 24 is mounted. This compressible material 24 may either be bonded or otherwise fixed via an adhesive on said the rearward side of said hard plastic layer 25. Said compressible material 24 has an arc-shaped curvature matching likewise the hard plastic's layer 25 shape. Said compressible material 24 may be a foam having open cells or a rubber component or the like allowing to adopt a compressed stage, but after the force being taken away adopting its normal shape again.

Said compressible material 24 may have a thickness between 20 and 25 or 30 mm, preferably about 22 mm. Below said compressible material 24 a cap base 26 is arranged. Said cap base 26 either may consist of metal or a hard plastic material. Said cap base 26 has a flat lower surface 31 the length of which matching said mounting surfaces length 29 arranged on the respective cylinder side walls. Said cap base 26 further comprises a curved surface 32 matching the curvature of said compressible material 24, said hard plastic layer 25 and said surface cover 20 having belt grooves.

The entire assembly of surface cover 20, hard plastic layer 25, compressible material 24, and cap base 26 respectively, is mounted to said mounting surfaces 29 by fastening means such as bolts or screws 22. Each of said layers of said layered structure of said cylinder surface sections 19 is provided with openings 21 arranged on the respective edge portions thereof, allowing for fast accessability of said sections 19 when dismounting of said sections 19 should be required.

Due to its layered structure, said cylinder surface section 19 endeavours higher mechanical stress and forces exerted upon respective cylinder circumference 9 upon a major paper jam. Since said assembly provides for an amount of compressibility of about 20 mm, said surface sections 19 will gradually deflect upon occurence of a product or signature jam. Provided, the cooperating paper conducting cylinder 5, i. e. for instance a folding blade cylinder, likewise is provided with a cylinder surface sections 19 according to the present invention, a deflecting range of about 40 mm is established between both cooperating cylinder surfaces 6, 9, respectively. Signatures which upon occurence of a jam will pile up on the respective cylinder surfaces 6, 9, respectively, will move respective compressible surface sections 19 versus the respective centreline of the cylinder 8 thus creating space for the paper stock.

The arrangement of said fastening means on respective edge portions of said cylinder surface sections 19 will allow for a short maintenance time to replace worn parts. Since said cylinder's surface sections 19 deflect about 20 mm towards a respective cylinder's centre axis, damage of the cylinder's components is significantly reduced, the downtime of a press-system can be reduced accordingly. Thus, starting-up after a product jam and an exchange of worn cylinder surface sections 19 is much faster as compared to known design. The entire cylinder cap assembly including cover 20, hard plastic layer 25, compressible material 24, and cap base 26—if necessary—can be replaced fast and easily. Due to the deflecting potential of the paper conducting cylinder's surfaces 6, 9 when equipped with the cylinder surface sections 19 damages to the stub shafts 15 mounted to the cylinder side walls can be prevented. Consequently, bearings of said stop shafts 15 are protected from damage upon occurence of a paper jam as well.

It should be worthwhile mentioning that the actuatable jaw member 18 is actuated via a cam follower 16 cooperating with a cam not shown in greater detail here. Said cam follower 16 attached to a lever member moves a shaft 27 journalled in bearings 28 in respective cylinder side wall portions about its axis allowing for actuating movement of said movable jaw member 18 towards the stationary jaw member 17. In the configuration presented in FIG. 2 of the present invention a jaw cylinder 8 is given having five actuatable jaws spaced upon its respective circumference 9.

Said cylinder surface sections 19 may be advantageously used in pinless folders. In pinless folders signature or newspaper transfer is achieved by sets of tapes or belt systems eliminating the need of retractable pin arrangements. Said covers 20 according to the present invention forming the top surface layer of the surface sections 19 entire assembly have belt grooves allowing for lateral guiding of transporting systems such as belts as coming along with pinless folders. However, folder designs having retractable product seizing elements such as pins can be equipped as well with the compressible surface sections 19 as presented in the invention. Upon newspaper production said newspaper having up to 48, 64, or 96 pages a deflecting range of 40 mm in the nip between said cooperating paper conducting cylinders 5, 8 can be achieved, protecting said cylinder from damage and allowing short start-up times after maintenance.

REFERENCE NUMERAL LIST

1 folder apparatus
2 cutting cylinders
3 first set of tapes
4 second set of tapes
5 first folding cylinder
6 surface
7 product transfer area
8 second folding cylinder
9 surface
10 set of tapes
11 delivery belt system
12 delivery path
13 side frame
14 web and resection
15 stop shaft
16 cam follower
17 fixed jaw
18 removable jaw
19 cylinder surface section
20 belt groove
21 opening
22 fasting means
23 arc-shaped lower section
24 compressible material
25 hard plastic layer
26 cap base
27 actuating shaft
28 bearing
29 mounting surface
30 hollow interior
31 flat surface
32 curved surface

What we claim is:

1. A paper conducting cylinder for use in a folder, comprising:

a cylinder having a plurality of mounting surfaces and a plurality of cylinder surface sections removably secured to said plurality of mounting surfaces, said plurality of cylinder surface sections defining a circumferential surface of said cylinder;

each one of said plurality of cylinder surface sections having a layered structure that includes a cover made from a highly wear resistant material, a hard Plastic stabilizing layer, and a compressible material attached to said hard plastic stabilizing layer.

2. Paper conducting cylinder according to claim 1, wherein said cover has belt grooves.

3. Paper conducting cylinder according to claim 2, wherein said cover is made of a hard urethane.

4. Paper conducting cylinder according to claim 2, wherein said cover is made of a rubber material.

5. Paper conducting cylinder according to claim 2, wherein said cover has a thickness of about 3–8 mm.

6. Paper conducting cylinder according to claim 2, wherein said cover has belt grooves for guiding edges of at least one belt.

7. Paper conducting cylinder according to claim 1, comprising a cap base mounted between said plurality of cylinder surface sections and said plurality of mounting surfaces.

8. Paper conducting cylinder according to claim 7, wherein said cap base is made of hard plastic.

9. Paper conducting cylinder according to claim 7, wherein said cap base is made of metal.

10. Paper conducting cylinder according to claim 1, wherein said hard plastic stabilizing layer has a hard surface for contacting at least one belt.

11. Paper conducting cylinder according to claim 1, wherein said compressible material is a compressible foamed material adhesively bonded to said hard plastic stabilizing layer.

12. Paper conducting cylinder according to claim 1, wherein said compressible material has a thickness of 15–25 mm.

13. Paper conducting cylinder according to claim 1, comprising removable fastening means for mounting said plurality of cylinder surface sections to said plurality of mounting surfaces.

14. Paper conducting cylinder according to claim 1, wherein said cylinder is a folding blade cylinder.

15. Paper conducting cylinder according to claim 1, wherein said cylinder is a jaw cylinder.

16. Paper conducting cylinder according to claim 1, wherein said cylinder is a collecting cylinder.

17. Paper conducting cylinder according to claim 1, wherein the paper conducting cylinder forms part of a folder apparatus.

18. Paper conducting cylinder according to claim 1, wherein the paper conducting cylinder forms part of a pinless folder apparatus.

19. Paper conducting cylinder according to claim 1, wherein the paper conducting cylinder forms part of a rotary printing press.

* * * * *